United States Patent [19]

Ikegami

[11] 4,218,872

[45] Aug. 26, 1980

[54] DISPLAY DEVICE FOR TIMEPIECE

[75] Inventor: Toshimasa Ikegami, Suwa, Japan

[73] Assignee: Kabushiki Kaisha Suwa Seikosha, Tokyo, Japan

[21] Appl. No.: 923,865

[22] Filed: Jul. 12, 1978

[30] Foreign Application Priority Data

Jul. 13, 1977 [JP] Japan ..... 52-93214[U]

[51] Int. Cl.[2] ..... G04B 19/00; G04B 19/06

[52] U.S. Cl. ..... 368/82; 368/29; 368/232

[58] Field of Search ..... 58/58, 4 A, 127 R, 50 R, 58/23 R

[56] References Cited

U.S. PATENT DOCUMENTS

| | | | |
|---|---|---|---|
| 3,945,191 | 3/1976 | van Berkum | 58/4 A |
| 3,973,388 | 8/1976 | Yoshida et al. | 58/50 R |
| 3,983,689 | 10/1976 | Burke et al. | 58/50 R |
| 4,149,146 | 4/1979 | Ebihara et al. | 58/23 R |

*Primary Examiner*—J. V. Truhe
*Assistant Examiner*—John B. Conklin
*Attorney, Agent, or Firm*—Blum, Kaplan, Friedman, Silberman & Beran

[57] ABSTRACT

A display device for a timepiece comprises an apertured dial and an electro-optical display element affixed to said dial so that said display element can be viewed through said aperture. The display device also includes an insulation layer and electrodes on said insulation layer.

12 Claims, 4 Drawing Figures

DISPLAY DEVICE FOR TIMEPIECE

BACKGROUND OF THE INVENTION

Until a few years ago all watches were mechanical in operation, a hand-wound spring being the source of energy. Such timepieces presented an analog display of time in hours, minutes and seconds. Where the day and data were displayed, the display could be considered to be digital, but the display was mechanically produced.

Wristwatches powered by an electro-chemical battery were developed, the display of hours, minutes and seconds still being presented in analog fashion. However, the development of large scale integrated circuitry made it possible to present all of the time units digitally, namely, hours, minutes, seconds, day and date. However, if the time is presented continuously, the drain upon the battery becomes excessive so that the life of the battery is unsatisfactorily short. Accordingly, provision must be made for activating the display only when the wearer of the wristwatch desires to know the time. This requirement necessitates the provision of special means for activating the display. In general, such means involve the use of both hands although special devices are available for activating the display without the use of both hands. Nevertheless, it would be desirable to display the time continuously and in analog fashion without excessive drain upon the battery, reserving the display of the day and date for those instances where the wearer desires this information. The present invention is designed to meet these needs. In addition, the present invention is designed to produce a digital display of the month, date, day, morning, afternoon, and battery life remaining, as well as other features in digital fashion in a watch which is thin relative to ordinary constructions.

SUMMARY OF THE INVENTION

A display device, in accordance with the present invention, includes a dial having a window therein and a display element formed as a unit with the dial, the display element being reserved for showing month, date, day, morning, afternoon, battery life and the like, the display of the time in hours, minutes and seconds being shown by means of conventional hands. The thickness of a timepiece including such a dial and display element may be minimized by incorporating at least one of the glass plates comprising said display element within the dial. The window in the dial through which the display element is viewed is preferably smaller in area than the display element itself so that the periphery of the display element extends beyond the periphery of the window.

The display device includes an insulation layer on the dial and electrodes on the insulation layer for connection to the display element. Also, the display element has an electrode face and the electrodes on said insulation layer are on the opposite side of said insulation layer from said electrode face.

In general, the electro-optical display element may include a liquid crystal cell or an electro-chromic cell. The cell of the display element has two electrode plates and one of said electrode plates, preferably, has a thickness less than 0.25 mm. The timepiece includes hands for providing an analog display of hours and minutes and circuitry for displaying digitally the day and the date through the use of said display element.

Accordingly, an object of the present invention is a display device for a timepiece including a dial having an aperture therein, an electro-optical display element visible therethrough said electro-optical display element being affixed to said dial.

Another object of the present invention is a display device for a timepiece for showing digitally one or more of the month, day, date, time relative to noon, the remaining life of the battery powering said timepiece and the like, said timepiece being designed for showing the time, at least in hours and minutes in analog fashion.

A further object of the present invention is a timepiece including a dial and a display element integral with said dial.

Yet another object of the present invention is a display device for a timepiece where the display device is of reduced thickness.

An important object of the present invention is a display device for a timepiece, said display device including an electro-optical display element which may be a liquid crystal cell or an electro-chromic cell.

A significant object of the present invention is a display device for a timepiece wherein a display element has an electrode face which is disposed within a dial.

Still other objects and advantages of the invention will in part be obvious and will in part be apparent from the specification.

The invention accordingly comprises the features of construction, combinations of elements, and arrangement of parts which will be exemplified in the constructions hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DESCRIPTION OF THE PREFERRED EMBODIMENTS

Where the display surface of an electro-optical display element is situated below the upper face of the dial of a timepiece, the contrast of the display is low, making it difficult to distinguish the features of the display. Moreover, in general, there is a setting mechanism at the 3-o'clock position for the sake of convenience in the arrangement of the movement so that the position at which the display can be set into the timepiece is limited. Where it is desired that the display be located at the 3-o'clock position, too many components must be included at the 3-o'clock position, such components being necessary for holding the electro-optical display element in place, making connections by means of leads between the display element and the circuitry, as a result of which the timepiece becomes complicated and thick.

Figure 1:
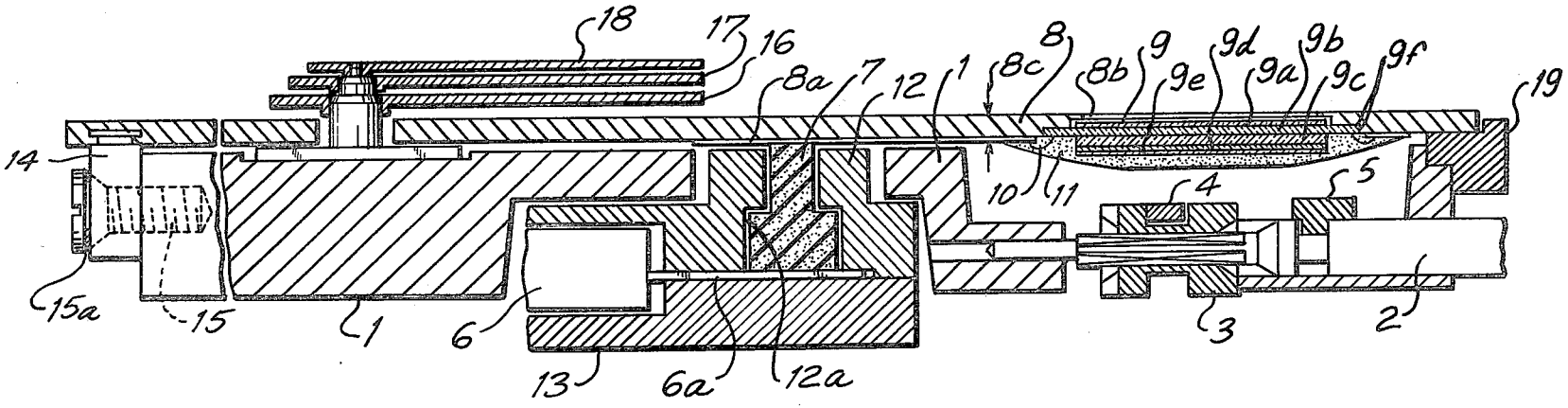
FIG. 1 is a sectional view of an embodiment of the invention.

FIG. 1 is a sectional view of an embodiment in accordance with the present invention which makes it possible to locate the display elements at any desired position in the face while keeping the thickness of the structure to a minimum. The timepiece, shown in FIG. 1, includes a plate 1, a winding stem 2 and a clutch wheel 3. Winding stem 2 is supported on plate 1 as shown and clutch wheel 3 is fitted with play to the chamferred portion of the winding stem 2, and clutch lever (yoke) 4 engages groove portion of clutch wheel 3. Setting lever 5 engages the groove portion of winding stem 2 and also clutch lever 4. These features constitute a conventional and well-known setting mechanism.

Hour hand 16, minute hand 17 and second hand 18 are positioned above dial 8 for showing the time in the usual analog fashion.

Display cell 9 for displaying date and day and dial base pillar 14 are formed as a unit with dial 8. Dial 8 is made of an insulation material such as a ceramic or a synthetic resin. Pattern wiring 8*a* is provided on a face of dial 8 for electrically connecting circuitry portion 6 and the transparent electrodes of liquid crystal cell 9.

Electro-optical cell 9 is viewed through window 8*b* in dial 8 and window 8*b* is preferably smaller than electro-optical cell 9, so that the periphery of cell 9 extends beyond the periphery of window 8*b* and the area of said cell is larger than the area of said window. Electro-optical cell 9 includes upper and lower panel glasses 9*b* and 9*c*, each having transparent electrodes for display formed thereon. Said cell 9 may be of the liquid crystal or electro-chromic type. Where said cell is of the liquid crystal type operating in the twisted nematic mode, said cell conventionally includes upper and lower panel glasses 9*b* and 9*c*, each having transparent electrodes for display thereon and upper and lower polarizing plates 9*a* and 9*d* as well as reflecting plate 93, and a spacer around the periphery of panel glasses 9*b* and 9*c* and liquid crystal within said cell.

Upper panel glass 9*b* is made larger than upper polarizing plate 9*a* in order to provide enough engaging surface, 9*f*, which engages with dial 8, and is made larger than the external form of the lower panel glass 9*c* to provide sufficient area for making contact between the transparent display electrodes and the pattern wiring 8*a*. The liquid crystal cell 9 is positioned both horizontally and vertically, as shown, by fitting the engaging surface 9*f* of upper panel glass 9*b* to the concave portion of dial 8, said concave portion being formed by a molding step or by cutting as with a milling cutter.

The electrical connection of the transparent electrodes on upper panel glass 9*b* and the pattern wiring 8*a* of dial 8 is subjected to a bonding treatment with metallic wire 10, and dial 8 and electro-optical cell 9 are made integral with each other by the use of mold material 11, as shown. This mold material can be an epoxy resin or the like.

The thickness of dial 8, conventionally, is low, namely, in the region of 0.3 to 0.4 mm. Preferably upper panel glass 9*b* is positioned completely within the plate thickness 8*c* of dial 8 as shown on the Figure. The thickness of upper panel glass 9*b* in such a construction is less than 0.25 mm and the thickness of lower panel glass 9*c* is also preferably below 0.25 mm.

Circuit element 6 is of the MOS IC type and is connected to the remaining operational components of the timepiece through lead plate 6*a* disposed between circuit case 12 and circuit support 13, circuit element 6 being fixed to plate 1 by means of screws and the like. Electrical connection between lead plate 6*a* and pattern wiring 8*a* of dial 8 is effected by means of conductive rubber 7. Conductive rubber 7 is supported in opening 12*a* of circuit case 12 so that shear of the contact surface with pattern wiring 8*a* is minimized, and the shape of conduit 12*a* is such that conductive rubber 7 remains in the circuit case 12 even when dial 8 is removed.

A holding ring 19 of synthetic resin is provided for holding the dial and said ring isolates pattern wiring 8*a* from plate 1 and outer attachments, said holding ring also serving as a cushioning medium. Further, clearance is provided for insulation between pattern wiring 8*a* and plate 1. In addition, an insulation material, such as a thin plate made of synthetic resin, may intervene, or pattern wiring 8*a* may be absent from the contact surface with plate 1. Also, with respect to that portion of plate 1 where pattern wiring is provided, insulation can be generated by providing clearance between plate 1 and pattern wiring 8*a*, such clearance being formed by the use of a milling cutter.

In the structure taught above, no dial base ring is required, the elimination of this component making it possible to reduce the thickness of the final timepiece. Also, dial screw 15 and dial base pillar 14 are fixed by means of inclined plane 15*a* and plate 1. Although not shown, an engagement of dial base pillar 14 with dial screw 15 is present at a plurality of locations, and window 8*b* of the dial is preferably located at the 3-o'clock postion. Needless to say, by adjustment of pattern wiring 8*a* on dial 8 it becomes possible to locate window 8*b* at any desired position on the dial. Also, the movement can be 1 caliber so that the dial 8 can be attached or detached easily.

Figure 2:
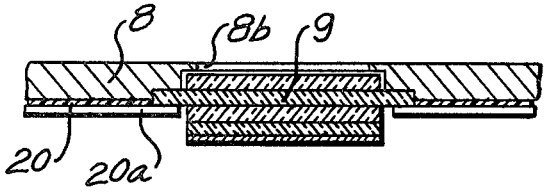
FIGS. 2, 3 and 4 are sectional views through a dial in accordance with the present invention showing the mounting of an electro-optical display element within the dial.

In the embodiment of FIG. 2, a conventional metallic plate is used for the dial 8. Base plate 20 is integrally formed from an insulating plate such as a thin circuit substrate and a metallic plate is fixed on dial 8. Pattern wiring 20*a* is provided on base plate 20 in a construction similar to that of the embodiment of FIG. 1. The display transparent electrodes on electro-optical cell 9 and pattern wiring 20*a* are connected as by welding, electro-optical cell 9 being formed as a unit with dial 8. In this embodiment, pattern wiring 20*a* is directed inwardly as compared with the insulating plate so that the display transparent electrodes of the electro-optical cell and the pattern wiring can be connected by welding, despite the presence of the opening in the insulating plate. The positioning of the electro-optical cell 9 and its relationship to window 8*b* are the same as in FIG. 1.

Figure 3:
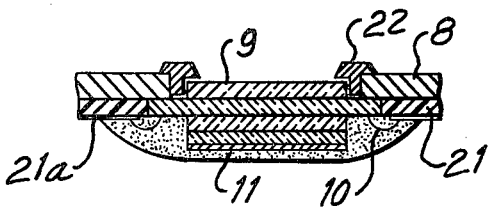

Referring now to FIG. 3, a dial 8 and an insulating plate 21 are shown, insulating plate 21 being provided with thick film printing or metallic foil or being a base plate made of an insulating plate to which a metallic plate is firmly attached so that said insulating plate and said metallic plate constitute a single piece joined with adhesives or cement. A window frame 22 is fixed on dial 8 to conceal the edges of electro-optical cell 9, the purpose being to improve the appearance of the structure. Base plate 21 has thereon pattern wiring 21*a* and electrical connection to transparent electrodes of the electro-optical cell 9 is effected by the use of metallic wire 10 which is held to the electrodes by means of a bonding treatment. Electro-optical cell 9 is held to dial 8 by means of molding material 11 which can be an epoxy.

Figure 4:
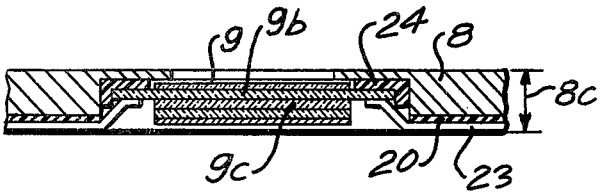

In the embodiment of FIG. 4, electro-optical cell 9 is held within the thickness 8*c* of dial 8. As before, the structure includes dial 8 and electro-optical cell 9 which may be either an electro-chromic cell or a liquid crystal cell. The structure also includes an insulating plate 20 to which is affixed lead plate 23 which functions similarly to the aforenoted pattern wiring. Lead plate 23 is bent so that a portion thereof presses against the display transparent electrodes of the electro-optical cell 9, and, preferably, lead plate 23 is elastic, the elasticity providing for a spring-like connection and thereby, for effective electrical conduction. The construction provides for integration of dial 8 and electro-optical cell 9.

The thickness 8*c* of a conventional dial 8 is from about 0.3 to about 1.0 mm. A liquid crystal cell or an electro-chromic cell can be contained within this thickness because the display to be provided by the display element of subject invention need not include hours, minutes or seconds as a result of which the display surface can be much smaller than that of the conventional liquid crystal cell or electro-chromic cell as provided in conventional complete displays. As a result, the respective component parts of electro-optical cell 9 can be made thinner than it is conventional. In addition, the external shape of upper panel glass 9*b* is designed to be larger than that of lower panel glass 9*c*. A cushioning member 24 of a synthetic resin or rubber is provided for the purpose of preventing the transfer of stress to the electro-optical cell 9 when the dial 8 is subjected to deformation. The cushioning member also serves to determine the location of dial 8 and electro-optical cell 9.

As is evident from the above description, integrating the electro-optical cell and the dial into a single unit in which the display surface is close to the upper face of the dial results in a display which is easy to see and makes it possible to locate the window position at the choice of the designer anywhereon the dial. In addition, the structure facilitates the mounting and removal of the dial and simplifies the method of electrical connection between the circuitry and the display electrodes. Furthermore, by constructing the dial and the display cell so that at least a portion of the display cell lies within the thickness of the dial, a thinner timepiece for displaying both the day and the date can be offered.

The structure also has a further advantage that electrical connection between the lead plate of the MOS IC and the dial is made by means of a conductive rubber. In addition, it is permissible for the lead plates to be bent and the elasticity thereof to be used for making electrical connections. Although the dial and the plate are shown as being held together by means of a screw, it is also possible to use eccentric pins or to provide a tapped hole in the dial base pillar for a screw and a hole for supporting the dial base pillar in the plate and to fasten the system together by means of a screw from the bottom side of the timepiece.

Although the drawings show structures corresponding to liquid crystal cells, as aforenoted, the overall structure is such that the display elements can well be an electro-chromic cell or a pleochroic cell. Further, the display element is not limited to day and date but may also show month, A.M. or P.M., battery life and intermittent seconds. A further point is that if the upper panel glass of the liquid crystal cell and the upper polarizing plate are similar in size and shape and are affixed to the dial, the strength of the structure will be greater than if only the upper panel glass is fixed to the dial, thereby leading to improvement in the quality of the liquid crystal display cell and of the entire display device.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A display device for an electronic timepiece, comprising:

a dial having inner and outer portions, at least the inner portion of said dial being of an insulating material, said dial having a first aperture therein;

hands for performing an analog display of time, said hands having axes passing through said first aperture;

an electro-optic digital display element affixed directly to said inner portion of said dial and integral therewith, said display element including connecting terminal means and said dial having a second aperture therein for viewing of said display element;

circuit means for activating said electro-optical display element;

conductor means directly engaging said insulating inner portions of said dial for connecting said circuit means with said connecting terminal means of said display element.

2. The display device as defined in claim 1, wherein said dial has a recess in the inner portions thereof, said recess connecting with said second aperture, the area of said aperture being smaller than that of said display element, said display element being at least partly disposed within said recess, and the periphery of said display element extending beyond that of said second aperture.

3. The display device as defined in claim 2, wherein said display element includes an upper panel glass having said connecting terminal means and transparent electrodes thereon, at least said upper panel glass being disposed within said recess and thereby within the thickness of said dial.

4. The display device as defined in claim 1, wherein said electro-optical display element has two electrode plates, and one of said electrode plates lies within the thickness of said dial, the thickness of said electrode plate being less than 0.25 mm.

5. The display device as defined in claim 1, wherein said electro-optical display element is a liquid crystal cell.

6. The display device as defined in claim 1, wherein said electro-optical display element is an electro-chromic cell.

7. The display device as defined in claim 1, wherein said circuit means is connected with said display element for displaying digitally day and date by said display element.

8. The display device as defined in claim 1, further comprising resilient lead plate means for electrically connecting said conductor means with said connecting terminal means.

9. The display device as defined in claim 1, further comprising lead plate means for electrically connecting said circuit means with said conductor means.

10. The display device as defined in claim 1, wherein said inner and outer portions are both of insulating material and said dial is of one-piece construction.

11. The display device as defined in claim 1, wherein said outer portion and said inner portion are separate but contiguous members.

12. The display device as defined in claim 1, further comprising resin affixing said display means integrally with said dial.

* * * * *